US006547524B2

(12) United States Patent
Kohli et al.

(10) Patent No.: US 6,547,524 B2
(45) Date of Patent: Apr. 15, 2003

(54) FILM COOLED ARTICLE WITH IMPROVED TEMPERATURE TOLERANCE

(75) Inventors: Atul Kohli, Vernon, CT (US); Joel H. Wagner, Wethersfield, CT (US); Andrew S. Aggarwala, East Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/861,753

(22) Filed: May 21, 2001

(65) Prior Publication Data

US 2002/0172596 A1 Nov. 21, 2002

(51) Int. Cl.[7] ..... F01D 5/18
(52) U.S. Cl. ..... 416/97 R; 416/96 R; 415/115
(58) Field of Search ..... 416/1, 96 R, 96 A, 416/97 R; 415/116, 115

(56) References Cited

U.S. PATENT DOCUMENTS 3,515,499 A * 6/1970 Beer et al.
4,676,719 A * 6/1987 Auxier et al. ..... 416/97 R
4,726,735 A 2/1988 Field et al. ..... 416/97
6,099,251 A * 8/2000 LaFleur ..... 416/97 R
6,139,258 A 10/2000 Lang, III et al. ..... 415/116
6,142,912 A 11/2000 Profaci ..... 482/8
6,164,912 A * 12/2000 Tabbita et al. ..... 416/97 R
6,210,112 B1 * 4/2001 Tabbita et al. ..... 416/97 R
6,241,468 B1 * 6/2001 Lock et al. ..... 415/115

FOREIGN PATENT DOCUMENTS

GB 2127105 A 4/1984 ..... F01D/5/18

* cited by examiner

*Primary Examiner*—Edward K. Look
*Assistant Examiner*—James M McAleenan
(74) *Attorney, Agent, or Firm*—Kenneth C. Baran

(57) ABSTRACT

The invention is a film cooled article such as a turbine engine blade or vane, having a wall with a hot surface 26 to be film cooled. The hot surface 26 includes a depression 48 featuring a descending flank 52 and an ascending flank 54. Coolant holes 60, which penetrate through the wall, have discharge openings residing on the ascending flank 54. During operation, the depression locally over-accelerates a primary fluid stream F flowing over the ascending flank while coolant jets 70 concurrently issue from the discharge openings. The local over-acceleration of the primary fluid deflects the jets onto the hot surface and spatially constrains the jets thus encouraging them to spread out laterally and coalesce into a laterally continuous, protective coolant film. In one embodiment, the depression 48 is a trough 50. In another embodiment, the depression is a dimple 72.

14 Claims, 4 Drawing Sheets

FIG.5A
Prior Art
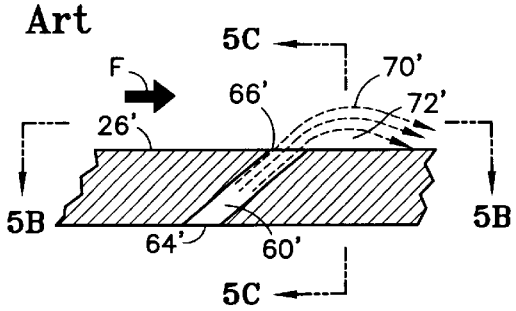
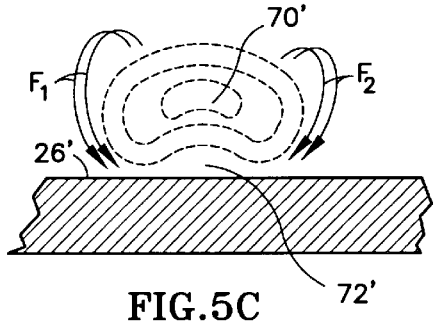
FIG.5C
Prior Art
FIG.5B
Prior Art
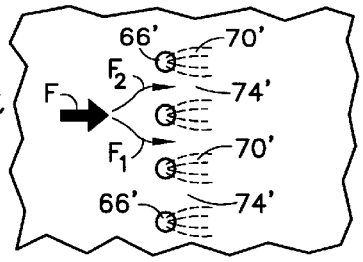
FIG.6A
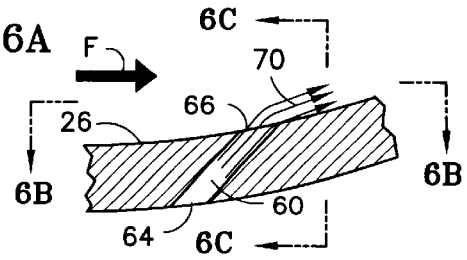
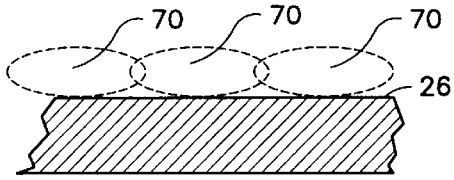
FIG.6C
FIG.6B
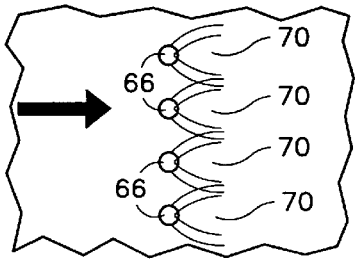

FILM COOLED ARTICLE WITH IMPROVED TEMPERATURE TOLERANCE

STATEMENT OF GOVERNMENT INTEREST

This invention was made under a U.S. Government Contract and the Government has rights herein.

TECHNICAL FIELD

This invention pertains to film cooled articles, such as the blades and vanes used in gas turbine engines, and particularly to a blade or vane configured to promote superior surface adherance and lateral distribution of the cooling film.

BACKGROUND OF THE INVENTION

Gas turbine engines include one or more turbines for extracting energy from a stream of hot combustion gases that flow through an annular turbine flowpath. A typical turbine includes at least one stage of blades and one stage of vanes streamwisely spaced from the blades. Each stage of blades comprises multiple, circumferentially distributed blades, each radiating from a rotatable hub so that an airfoil portion of each blade spans across the flowpath. Each stage of vanes comprises multiple, circumferentially distributed nonrotatable vanes each having airfoils that also span across the flowpath. It is common practice to cool the blades and vanes to improve their ability to endure extended exposure to the hot combustion gases. Typically, the employed coolant is relatively cool, pressurized air diverted from the engine compressor.

Turbine designers employ a variety of techniques, often concurrently, to cool the blades and vanes. Among these techniques is film cooling. The airfoil of a film cooled blade or vane includes an internal plenum and one or more rows of obliquely oriented, spanwisely distributed coolant supply holes, referred to as film holes. The film holes penetrate the walls of an airfoil to establish fluid flow communication between the plenum and the flowpath. During engine operation, the plenum receives coolant from the compressor and distributes it to the film holes. The coolant issues from the holes as a series of discrete jets. The oblique orientation of the film holes causes the coolant jets to enter the flowpath with a streamwise directional component, i.e. a component parallel to and in the same direction as the dominant flow direction of the combustion gases. Ideally, the jets spread out laterally, i.e. spanwisely, to form a laterally continuous, flowing coolant film that hugs or adheres to the flowpath exposed surface of the airfoil. It is common practice to use multiple, rows of film holes because the coolant film loses effectiveness as it flows along the airfoil surface.

Film cooling, despite its merits, can be challenging to execute in practice. The supply pressure of the coolant in the internal plenum must exceed the static pressure of the combustion gases flowing through the flowpath. Otherwise the quantity of coolant flowing through the film holes will prove inadequate to satisfactorily film cool the airfoil surfaces. At worst, the static pressure of the combustion gases may exceed the coolant supply pressure, resulting in ingestion of harmful combustion gases into the plenum by way of the film holes, a phenomenon known as backflow. The intense heat of the ingested combustion gases can quickly and irreparably damage a blade or vane subjected to backflow. However, the high coolant pressures required to guard against inadequate coolant flow and backflow can cause the coolant jets to penetrate into the flowpath rather than adhere to the surface of the airfoil. As a result, a zone of the airfoil surface immediately downstream of each hole becomes exposed to the combustion gases. Moreover, each of the highly cohesive coolant jets locally bifurcates the stream of combustion gases into a pair of minute, oppositely swirling vortices. The vertically flowing combustion gases enter the exposed zone immediately downstream of the coolant jets. Thus, the high pressure coolant jets not only leave part the airfoil surface exposed, but actually entrain the hot, damaging gases into the exposed zone. In addition, the cohesiveness of the jets impedes their ability to spread out laterally (i.e. in the spanwise direction) and coalesce into a spanwisely continuous film. As a result, strips of the airfoil surface spanwisely intermediate the film holes remain unprotected from the hot gases.

One way to encourage the coolant jets to adhere to the surface is to orient the film holes at a shallow angle relative to the surface. With the holes so oriented, the coolant jets will enter the flowpath in a direction more parallel than perpendicular to the surface. Unfortunately, installing shallow angle film holes is both expensive and time consuming. Moreover, such holes contribute little or nothing to the ability of the coolant to spread out laterally and coalesce into a continuous film.

A known film cooling scheme that helps to promote both lateral spreading and surface adherance of a coolant film relies on a class of film holes referred to as shaped holes. A shaped hole has a metering passage in series with a diffusing passage. The metering passage, which communicates directly with the internal coolant plenum, has a constant cross sectional area to regulate the quantity of coolant flowing through the hole. The diffusing passage has a cross sectional area that increases in the direction of coolant flow. The diffusing passage decelerates the coolant jet flowing therethrough and spreads each jet laterally to promote film adherance and lateral continuity. Although shaped holes can be beneficial, they are difficult and costly to produce. An example of a shaped hole is disclosed in U.S. Pat. No. 4,664,597.

What is needed is a cost effective film cooling scheme that encourages the cooling jets to spread out laterally across the surface of interest and to reliably adhere to the surface.

SUMMARY OF THE INVENTION

According to the invention, an article having a wall with a hot surface, for example a turbine engine blade or vane, includes a depression featuring a descending flank and an ascending flank. Coolant holes, which penetrate through the wall, have discharge openings residing on the ascending flank. During operation, the depression locally over-accelerates a primary fluid stream flowing over the ascending flank while coolant jets concurrently issue from the discharge openings. The local over-acceleration of the primary fluid deflects the coolant jets onto the hot surface thus encouraging them to spread out laterally and coalesce into a laterally continuous, protective coolant film.

According to one aspect of the invention, the depression is a laterally extending trough. According to another aspect of the invention, the depression is a local dimple.

The principal advantage of the invention is its ability to extend the useful life of a cooled component or to improve the component's tolerance of elevated temperatures without sacrificing component durability. The invention may also make it possible to increase the lateral spacing between discrete film holes, thus economizing on the use of coolant and improving engine performance, without adversely affecting component life. The invention also minimizes the designer's incentive to reduce coolant supply pressure and accept the attendant risk of combustion gas backflow in an effort to promote film adherance.

BRIEF DESCRIPTION OF THE DRAWINGS

FIGS. 5A, 5B and 5C are schematic illustrations showing coolant jets issuing from film holes of a prior art turbine blade or vane.

FIGS. 6A, 6B and 6C are schematic illustrations showing coolant jets issuing from film holes of the inventive turbine blade or vane.

BEST MODE FOR CARRYING OUT THE INVENTION

Figure 1:
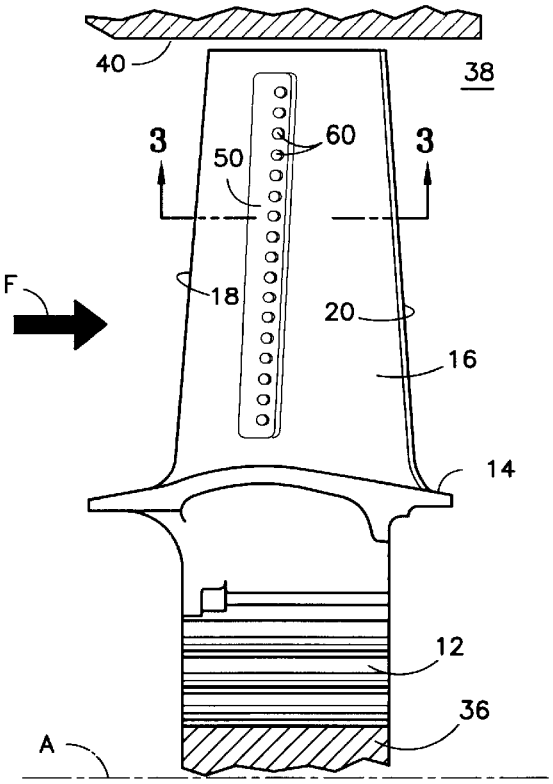
FIG. 1 is a side elevation view of a turbine blade for a gas turbine engine showing a spanwisely extending depression in the form of a trough and also showing coolant holes whose discharge openings are orifices that reside on an ascending flank of the trough.
Figure 3:
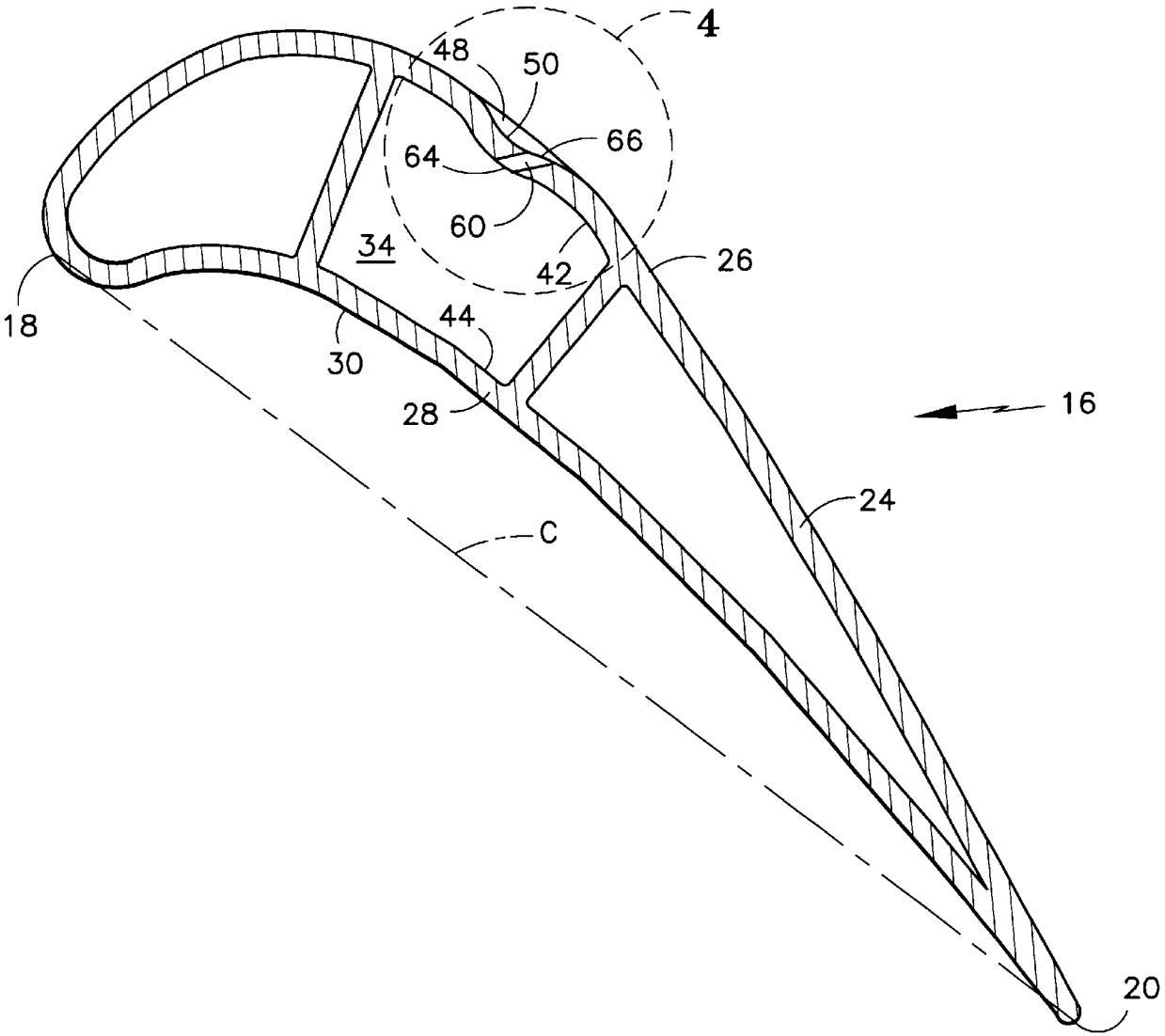
FIG. 3 is a view taken in the direction 3—3 of FIG. 1 showing the airfoil of the inventive turbine blade in greater detail and also showing an internal coolant plenum, the illustration also being representative of a similar view taken in direction 3—3 of FIG. 2.
Figure 3:
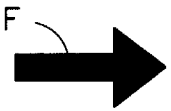

FIGS. 1 and 3 illustrate a turbine blade for the turbine module of a gas turbine engine. The blade includes a root 12, a platform 14 and airfoil 16. The airfoil has a leading edge 18, defined by an aerodynamic stagnation point, a trailing edge 20, and a notional chord line C extending between the leading and trailing edges. The airfoil has a wall comprised of a suction wall 24 having a suction surface 26, and a pressure wall 28 having a pressure surface 30. Both the suction and pressure walls extend chordwisely from the leading edge to the trailing edge. One or more internal plenums, such as representative plenum 34, receive coolant from a coolant source, not shown. In a fully assembled turbine module, a plurality of circumferentially distributed blades radiates from a rotatable hub 36, with each blade root being captured in a corresponding slot in the periphery of the hub. The blade platforms collectively define the radially inner boundary of an annular fluid flowpath 38. A case 40 circumscribes the blades and defines the radially outer boundary of the flowpath. Each airfoil spans radially across the flowpath and into close proximity with the case. During operation, a primary fluid stream F comprised of hot, gaseous combustion products flows through the flowpath and over the airfoil surfaces. The flowing fluid exerts forces on the airfoils that cause the hub to rotate about rotational axis A.

The suction and pressure walls 24, 28 each have a cold side with relatively cool internal surfaces 42, 44 in contact with the coolant plenum 34. Each wall also has a hot side represented by the external suction and pressure surfaces 26, 30 exposed to the hot fluid stream F. The hot surface 26 includes a depression 48 in the form of a trough 50. Although the trough 50 is illustrated as extending substantially linearly in the spanwise direction, other trough configurations are also contemplated. For example, the trough may be spanwisely truncated, or may extend, at least in part, in both the spanwise and chordwise directions, or the trough may be nonlinear.

Figure 4:
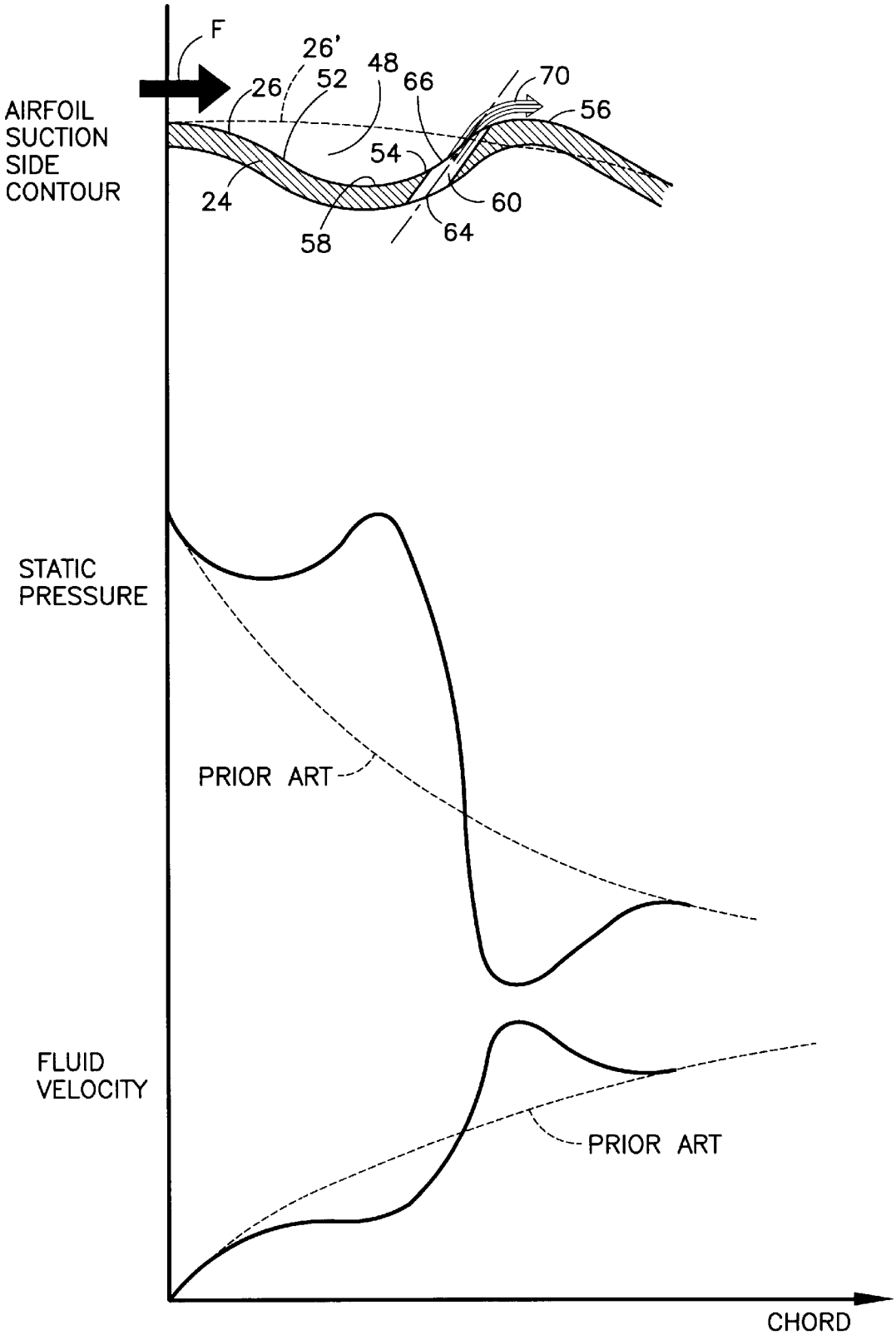
FIG. 4 is an enlarged view similar to FIG. 3 showing the trough of FIG. 1 or a dimple of FIG. 2 in greater detail and graphically depicting the static pressure and velocity of combustion gases flowing over the trough.

As seen best in FIG. 4, the trough has a descending flank 52 and ascending flank 54. A gently contoured ridge 56 may border the aft end of the trough. The ridge rises above, and then blends into a conventional airfoil contour 26', shown with broken lines. A floor 58, which is neither descending nor ascending, joins the flanks 52, 54. In the illustrated embodiment, the floor 58 is merely the juncture between the descending and ascending flanks, however the floor may have a finite length. A row of film coolant holes 60, penetrates the wall to convey coolant from the cold side to the hot side. Each hole has an intake opening 64 on the internal surface of the penetrated wall and a discharge opening in the form of an orifice 66 on the external surface of the penetrated wall. Each discharge opening resides on the ascending flank of the trough. The film coolant holes are oriented so that coolant jets discharged therefrom enter the primary fluid stream F with a streamwise directional component, rather than with a counter-streamwise component. The streamwise directional component helps ensure that the coolant jets adhere to the hot surface rather than collide and mix with the primary fluid stream F.

Figure 1A:
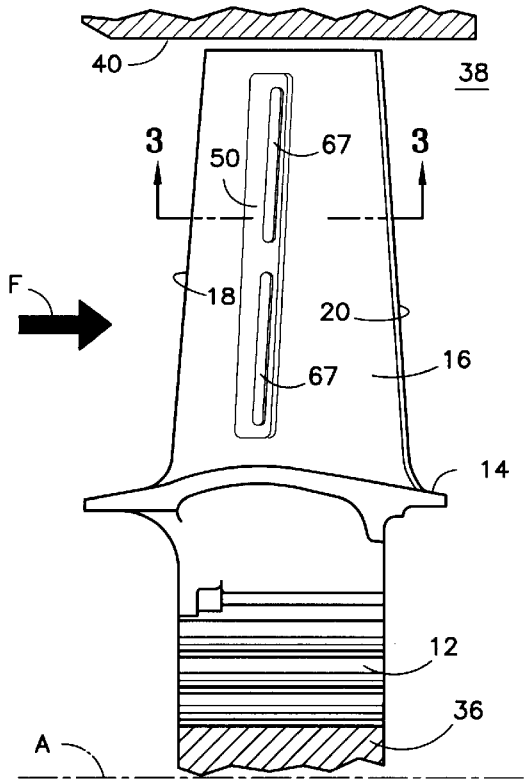
FIG. 1A is a view similar to FIG. 1 but showing coolant discharge openings in the form of spanwisely extending slots.

FIG. 1A illustrates a variant of the invention in which one or more spanwisely extending discharge slots 67 introduce coolant into the flowpath 38 and thus serve the same purpose as the discharge orifices 66. Each slot, like the discharge orifices 66, resides on the ascending flank of the trough 50. The discharge slot may penetrate all the way through the wall 24 to the plenum 34 or may communicate with the plenum by way of one or more discrete, sub-surface feed passages.

Figure 2:
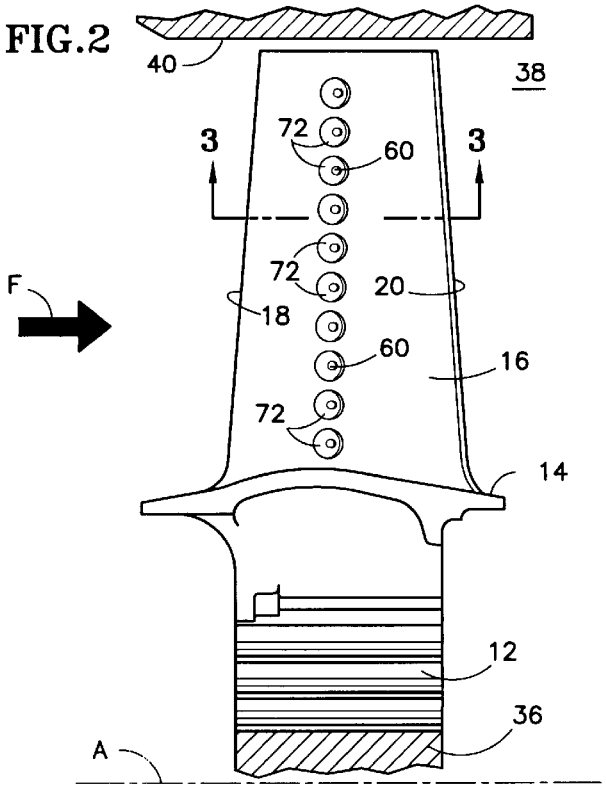
FIG. 2 is a view similar to FIG. 1 but showing the depression in the form of a spanwisely extending array of dimples with coolant hole discharge orifices residing on ascending flanks of the dimples.
Figure 2A:
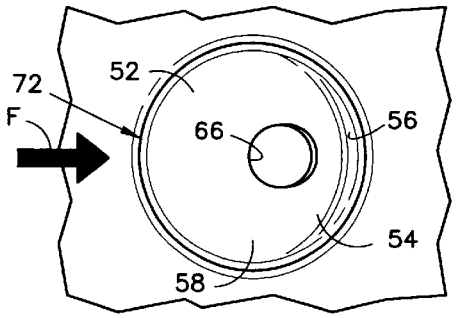
FIG. 2A is an enlarged view of one of the dimples shown in FIG. 2.
Figure 2B:
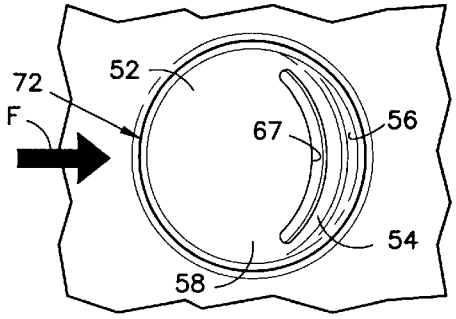
FIG. 2B is a view similar to that of FIG. 2A, but showing a coolant discharge opening in the form of a slot.

FIGS. 2 and 2A show an alternate embodiment of the invention in which the depression is an array of spanwisely distributed dimples 72 and the discharge opening is an orifice 66. FIGS. 3 and 4, although previously referred to in the context of the trough 50, are also representative of a cross-sectional view taken through a typical dimple 72. Although the illustrated dimples form a substantially linear, spanwisely extending dimple array, other dimple array configurations are also contemplated. For example, the array may be spanwisely truncated or may extend, at least in part, in both the spanwise and chordwise directions, or the array may be nonlinear. The discharge opening of the coolant hole, although illustrated as an orifice, may take other forms, for example a slot 67 as seen in FIG. 2B Each dimple 72 has a descending flank 52 and an ascending flank 54. A gently contoured ridge 56 borders the aft end of each dimple. A floor 58 joins the flanks as described above. In the illustrated embodiment each dimple has a semi-spherical shape, however other shapes may also be satisfactory. A single discharge opening resides on the ascending flank of each dimple, the opening being spanwisely centralized between the lateral extremities of the dimple. However, the opening may be spanwisely offset on the ascending flank or multiple openings may reside on the ascending flank of each dimple if desired.

The operation of the invention is best understood by referring to FIG. 4, which shows an enlarged cross-sectional view of an airfoil suction surface incorporating an exemplary inventive depression 48. The illustration of FIG. 4 is somewhat exaggerated to ensure its clarity. FIG. 4 also shows the chordwise variation in static pressure and velocity of the primary fluid stream F flowing over the inventive surface 26 or prior art surface 26'.

Considering first the prior art surface depicted with broken lines, the static pressure of the fluid stream F decreases in the chordwise direction, causing a corresponding acceleration of the fluid as is evident from the slope of the velocity graph. By contrast, the depression 48 of the inventive airfoil causes a localized perturbation in the static pressure field as the primary fluid flows over the depression. In particular, the depression provokes an increase in the static pressure as the primary fluid flows over the descending flank 52. Then, as the fluid flows over the ascending flank 54, the static pressure drops precipitously causing a local over-acceleration of the fluid stream as revealed by the steep slope of the velocity graph. For the illustrated surface, the over-acceleration locally overspeeds the fluid stream aft of the discharge opening 66. Because of the local over-acceleration, the primary fluid stream deflects the coolant jets 70 issuing from the film coolant holes so that the jets adhere to the surface 26. By deflecting the coolant jets onto the surface 26, the local acceleration of the primary fluid stream also spatially constrains the jets, encouraging them to spread out laterally and coalesce into a laterally continuous coolant film. The ridge 56 and/or a more aggressive slope on the ascending flank than on the descending flank may enhance the over-acceleration and will govern the extent of the overspeed, if any.

These phenomena are seen more clearly in the schematic, comparative illustrations of FIGS. 5 and 6. FIGS. 5A, 5B and 5C show how the relatively modest fluid acceleration in the vicinity of the film coolant hole 60' of a conventional airfoil may contribute to suboptimal film cooling. In FIG. 5A, a typical coolant jet 70' penetrates a small distance into the flowpath leaving zone 72' unprotected. As seen in FIGS. 5B and 5C, each of the discrete cooling jets locally bifurcates the fluid stream F into vertically flowing substreams $F_1$, $F_2$ of hot combustion gases. The vertically flowing substreams then become entrained into the unprotected zone 72' between the cooling jets 70' and the airfoil surface 26'. Accordingly, the prior art film cooling arrangement not only leaves zone 72' unprotected, but also encourages the hot gases to flow into the unprotected zone. In addition, the discrete cooling jets leave strips 74' of the airfoil surface, spanwisely intermediate the discharge openings, exposed to damage from the hot gases (FIG. 5B).

FIGS. 6A, 6B and 6C show how the depression of the inventive airfoil offers superior protection of the airfoil surface. As seen in FIGS. 6A and 6C, in contrast to FIGS. 5A and 5C, the local over-acceleration and local overspeeding of the fluid stream F deflects the coolant jets 70 onto the airfoil surface, thus effectively eliminating exposed zone 72' shown in FIGS. 5A and 5C. As seen best in FIGS. 6B and 6C, the over-accelerated and oversped fluid stream also helps to spatially constrain the coolant jets. The spatial constraint causes the jets to spread out laterally and coalesce into a laterally continuous coolant film, effectively eliminating the unprotected strips 74 of FIG. 5B.

Because the invention achieves superior film cooling, the blade enjoys extended life or can endure a higher temperature fluid stream F without suffering a reduction of life. The invention may also allow the blade designer to use fewer, more widely separated film holes thus economizing on the use of coolant without jeopardizing blade durability. Economical use of coolant improves overall engine efficiency because the coolant is usually pressurized working medium air extracted from the engine compressor. Once extracted and ducted to the turbine for use as coolant, the useful energy content of the air cannot usually be fully recovered. The invention also reduces any incentive for the blade designer to try to promote good film adherence by operating at a reduced coolant pressure and thereby incurring the risk of inadequate coolant flow or combustion gas backflow. Finally, the invention may dispense with the need to install costly, shallow angle film holes or shaped holes. However, it is not out of the question that some applications may benefit from the use of shallow angle film holes or shaped holes in conjunction with the inventive depression.

Although the invention has been shown as applied to the suction surface of a turbine blade, it is also applicable to other cooled surfaces of the blade such as the pressure surface 30 or the blade platform. The invention may also be used on turbine vanes and other film cooled articles such as turbine engine ducts and outer airseals.

We claim:

1. A coolable blade or vane for a turbine engine, comprising:

a wall having a hot side with a hot surface and a cold side with a cold surface, the hot surface including a depression with a descending flank and an ascending flank, the depression residing between a leading edge and a trailing edge of the blade or vane; and a coolant hole penetrating through the wall to convey coolant from the cold side to the hot side, the coolant hole having a coolant intake opening on the cold side of the wall and a coolant discharge opening on the hot side of the wall, the discharge openings residing on the ascending flank of the depression.

2. The blade or vane of claim 1 wherein the depression is a trough having multiple discharge openings residing thereon.

3. The blade or vane of claim 1 wherein the discharge opening is an orifice.

4. The blade or vane of claim 1 wherein the discharge opening is a slot.

5. The blade or vane of claim 2 wherein the trough extends substantially linearly in the spanwise direction.

6. The blade or vane of claim 1 wherein the depression is one or more dimples.

7. The blade or vane of claim 6 wherein the one or more dimples is a substantially linear, spanwisely extending array of dimples.

8. The blade or vane of claim 1 wherein a primary fluid stream flows over the hot surface in a streamwise direction and the coolant hole is oriented so that coolant discharged therefrom enters the primary stream with a streamwise directional component.

9. The blade or vane of claim 1 wherein a ridge borders an aft end of the depression.

10. The blade or vane of claim 1 wherein a primary fluid stream flows over the hot surface and the depression locally perturbs the static pressure field of the primary fluid and over-accelerates the fluid stream aft of the discharge opening.

11. The blade or vane of claim 10 wherein the depression locally overspeeds the fluid stream aft of the discharge opening.

12. A coolable blade or vane for a turbine engine, comprising:

a suction wall extending from a leading edge to a trailing edge, the suction wall having an external surface exposed to a primary stream of hot fluid and an internal surface;

a pressure wall spaced from the suction wall and joined thereto at the leading and trailing edges, the pressure wall also having an external surface exposed to the primary stream of hot fluid and an internal surface;

a row of coolant holes penetrating at least one of the walls;

each coolant hole having a coolant intake opening on the internal surface of the penetrated wall and a coolant discharge opening on the external surface of the penetrated wall;

the penetrated wall having a trough residing between the leading edge and the trailing edge, the trough having a descending flank and a ascending flank, the coolant discharge openings residing on the ascending flank of the trough.

13. A coolable blade or vane for a turbine engine, comprising:

a suction wall extending from a leading edge to a trailing edge, the suction wall having an external surface exposed to a primary stream of hot fluid and an internal surface;

a pressure wall spaced from the suction wall and joined thereto at the leading and trailing edges, the pressure wall also having an external surface exposed to the primary stream of hot fluid and an internal surface;

a row of coolant holes penetrating at least one of the walls;

each coolant hole having a coolant intake opening on the internal surface of the penetrated wall and a coolant discharge opening on the external surface of the penetrated wall;

the penetrated wall having an array of dimples each with a descending flank and an ascending flank, the dimple array residing between the leading edge and the trailing edge, the coolant discharge openings residing on the ascending flanks of the dimples.

14. The blade or vane of claim 13 wherein each dimple accommodates exactly one discharge opening.

* * * * *